United States Patent [19]

Shaikh

[11] 4,046,219

[45] Sept. 6, 1977

[54] EXHAUST SILENCER APPARATUS FOR INTERNAL COMBUSTION ENGINE

[75] Inventor: Nisar Shaikh, Fond du Lac, Wis.

[73] Assignee: Brunswick Corporation, Skokie, Ill.

[21] Appl. No.: 560,148

[22] Filed: Mar. 20, 1975

[51] Int. Cl.[2] ..... F01N 5/00; F01N 5/02

[52] U.S. Cl. ..... 181/211; 181/250; 181/252; 181/279

[58] Field of Search ..... 60/312, 314; 181/42, 181/48, 36 C, 36 D, 59, 66, 36 R, 50, 36 E

[56] References Cited

U.S. PATENT DOCUMENTS

| | | | |
|---|---|---|---|
| 1,816,109 | 7/1931 | Bourne | 181/66 X |
| 1,818,375 | 8/1931 | Bourne | 181/66 X |
| 3,180,712 | 4/1965 | Hamblin | 181/48 X |
| 3,462,947 | 8/1969 | Nowak | 60/314 |
| 3,692,142 | 9/1972 | Stemp | 181/50 |
| 3,703,937 | 11/1972 | Tenney | 181/36 R |
| 3,786,791 | 1/1974 | Richardson | 181/42 X |
| 3,786,897 | 1/1974 | Swanson | 181/48 X |
| 3,842,599 | 10/1974 | Ehlen | 60/312 X |

FOREIGN PATENT DOCUMENTS

| | | | |
|---|---|---|---|
| 1,147,769 | 4/1963 | Germany | 181/48 |

*Primary Examiner*—John Gonzales

*Attorney, Agent, or Firm*—Andrus, Sceales, Starke & Sawall

[57] ABSTRACT

A tuned pipe exhaust for a two cycle internal combustion engine for snowmobiles and the like includes a conically shaped converging megaphone section terminating in a small end tube. An absorptive spiral muffler unit is co-axially secured to the end tube and includes an inner radial end wall extending radially from the end tube. The muffler unit attenuates high frequency exhaust noise. The space between such end wall and the upstream conical wall of the tuned pipe is enclosed with a tubular resonator wall to define a resonator cavity with coupling opening in the end tube. The cavity and throat opening defines a Helmholtz resonator which attenuates low frequency exhaust noise. The combination of a low frequency reactive section and a high frequency absorptive section creates an effective balanced silencer operating over the normal frequency spectrum of such engines.

13 Claims, 5 Drawing Figures

EXHAUST SILENCER APPARATUS FOR INTERNAL COMBUSTION ENGINE

BACKGROUND OF THE INVENTION

This invention relates to an exhaust silencer for small internal combustion engines and particularly to an exhaust silencer employing multiple silencing stages.

Internal combustion engines are generally constructed with an exhaust silencer or muffler unit connected with the exhaust gas passageway. Various muffler constructions have been suggested to reduce the exhaust noises associated with internal combustion engines without affecting the performance of the engine. This is particularly true with small two-cycle engines employed in recreational vehicles such as snowmobiles and other off-road devices. The demand for improved noise reduction has increased with recent noise regulations and standards which are promulgated by various governmental organizations or units. Consequently, the provision of a highly efficient silencer has become increasingly important in the practical production and sale of such recreational vehicles.

Generally, the internal combustion engines are adapted to operate at a given revolution per minute and the exhaust system is generally provided with a power tuning pipe to maximize the efficiency of operation at normal operating RPM. The muffler is connected to the discharge end of the tuning pipe to significantly reduce the undesirable noise levels associated with such engines. A widely employed and satisfactory muffler which has been employed includes a small cylindrical member with an internal spiral duct lined with a suitable absorbing medium such as steel wool. The spiral chamber or housing is secured to the terminal end of the tuned exhaust pipe with the absorption characteristics such as to significantly reduce the noise output. The unit is reasonably small, compact and, thus, is adapted to recreational type vehicles. Absorptive muffler unit, however, attenuate the exhaust noise over a relatively narrow frequency range or spectrum and an undesirable and in some instances unacceptable noise level remains.

Theoretically, various control techniques employing intricate passageways can be readily constructed to further minimize the noise characteristic. However, many control techniques involves development of intricate passageways create increased back pressures in the exhaust system simultaneously with the noise reduction with an undesirable if not unacceptable reduction of power output of the engine. Long pipe and big volume reasonators can also technically reduce the noise level and provide a theoretical solution. Long pipe and other large volumne resonators are not, therefore, particularly adapted to recreational vehicles because of the size and weight. Further, such designs generally include an significant cost factor which may prevent practical implementation.

Consequently, a significant demand exists in the silencer art particularly for two cycle engines employed in recreational vehicles for a small reliable, lightweight and inexpensive muffler silencer unit which produces the desired sound attenuation without unduly increasing of the exhaust back pressures or otherwise degrading engine operation.

SUMMARY OF THE PRESENT INVENTION

The present invention is particularly directed to a silencing apparatus for internal combustion engine exhaust systems and generally includes multiple silencing stages to significantly increase the reduction in the noise components in different frequency spectrums to thereby increase the total noise reduction without unduly increasing the size, weight or cost of the silencing system. Generally in accordance with the present invention, a reactive low frequency resonator silencer is connected in series with a high frequency absorptive silencer an an integrated part of the exhaust passageway or piping means. The absorptive section may conveniently be a spiral chamber unit with the noise absorbing lining. The reactive section includes a resonant chamber secured in encircling relation to an exhaust conduit means and coupled thereto by a small throat section in a common wall portion of the resonant chamber and the exhaust passageway. The volume of the resonator cavity and size of the throat section is selected to significantly reduce low frequency components of the exhaust while the absorptive section operates to eliminate the noise components in a high frequency spectrum.

In a particularly unique and practical exhaust system, a tuned pipe exhaust is employed with a conically shaped discharge or converging megaphone portion terminating in a small tubular extension. An absorptive chamber unit is co-axially mounted to receive the exhaust gases from the tubular extension and defines an outwardly projecting wall generally to the outer peripherial portion of the converging megaphone. The space between such projecting wall and the upstream conical wall of the tuned pipe is enclosed with a tubular resonator wall to define a resonator cavity which is coupled to the exhaust passageway by a throat or opening which may be formed by spacing the tubular extension from the projecting wall or as separate opening means in a continuous tubular extension. The cavity in combination with the throat opening defines a resonator of the type known in the art as a Helmholtz resonator. The cavity volume and the diameter of the throat opening or area of the throat opening, controls the resonant frequency and consequently the effective attenuation of the exhaust noise component.

Applicant has found that the combination of a low frequency reactive section and a high frequency absorptive section to correspondingly reduce the low and high frequency components of the exhaust noise creates an effective well-balanced muffler or silencer operating over a relatively broad spectrum and one which is particularly effective over the normal frequency spectrum of small two-cycle internal combustion engines such as employed in recreational vehicles.

The present invention, thus, provides a relatively inexpensive silencer construction which does not unduly enlarge the size of the exhaust piping nor does it significantly increase the weight or cost. It is, therefore, uniquely capable of practical implementation in the field of recreational vehicles subject to relatively stringent regulations and specification by various groups and governmental organizations.

BRIEF DESCRIPTION OF DRAWING

The drawing furnished herewith illustrates a preferred construction of the present invention in which the above advantages and features are clearly disclosed as well as others which will be readily understood from the following description.

In the drawing.

DESCRIPTION OF ILLUSTRATED EMBODIMENTS

Figure 1:
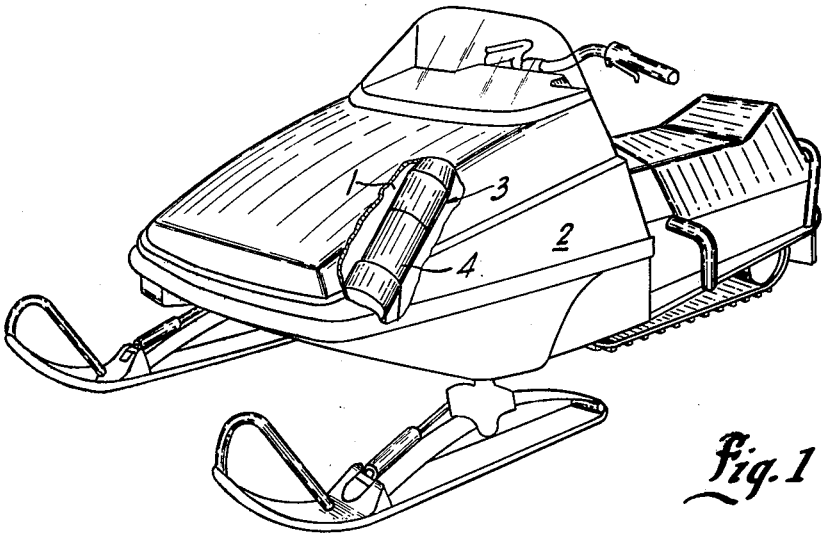
FIG. 1 is a simplified diagrammatic illustration of a snowmobile unit incorporating an improved silencer or muffler structure in accordance with the teaching of the present invention.

Referring to the drawing and particularly to FIG. 1, the present invention is shown applied to a snowmobile vehicle including a small two-cycle internal combustion engine 1 mounted to the forward end of a vehicle chassis 2. An engine exhaust piping unit or assembly 3 extends from the engine exhaust manifold 3*a* to discharge the exhaust gases downwardly toward the ground. Generally, the exhaust piping unit 3 includes a tuning pipe 4 which tunes the exhaust system to the normal operation revolutions per minute RPM of the engine 1. For example, in a commercially available snowmobile, engine 1 will conventionally operate at a speed within a range between 6000 and 10,000 RPM. The power tuning pipe 4 will be constructed to provide maximum operating efficiency at such speed. To reduce the noise generated by the exhaust gases, the power tuning pipe 4 is coupled to a novel two stage silencing system, which in the illustrated embodiment of the invention of FIGS. 1–3 includes a downstream high frequency absorptive muffler unit 5 secured to end of pipe 4 and an immediately adjacent upstream low frequency reactive muffler unit 6. As more fully developed hereafter, the muffler unit 5 is preferably an absorption section which significantly attenuates noise components of the exhaust over a reasonable range of high frequencies which will significantly attenuate the noise components of the exhaust over a reasonable range of low frequencies. The illustrative two stage muffler construction provides a unique, extremely compact system which can be readily incorporated into small recreational vehicles such as a snowmobile.

More particularly, the tuned exhaust pipe 4 is of a generally conventional construction and includes a diverging input megaphone section 7 connected to a central tubular straight section 8 of a constant diameter with conical converging discharge megaphone section 9. The several section 7 – 9 are integrally formed or separately formed and welded to each other and to the balance of the piping system. Thus, the input section 7 is coupled to the engine manifold 3*a* through a suitable expansion conduit 10 and section 9 generally forms the terminal or outermost portion of the exhaust passageway system.

In the illustrated embodiment of the present invention, a small tubular coupling pipe 11 is secured to the outer end of the megaphone section 9 as by a weld 12 ro the like and extends coaxially therefrom. The muffler unit 5 is secured to the outer end of the coupling pipe 11. Generally, the muffler unit 5 is illustrated including an outer cylindrical housing 13 having an inner tubular inlet 14 secured to or telescoped with the outer end of the coupling pipe 11. An internal spiral passageway wall 15 within housing 13 terminates in a peripherial discharge nozzle or opening element 16. The passageway is filled with a suitable sound absorbing medium 16 such as steel wool to absorb or attenuate high frequency components in the exhaust noise, for example, as discussed in U.S. Pat. No. 3,692,142. The opposite end faces of the housing 13 are closed by an inner end wall 17 which includes the inlet 14 and an axially outer wall 18. Thus, the exhaust gases move from the tuned exhaust pipe unit 4 and particularly from the coupling pipe 11 and are directed through the spiral exhaust sound absorbing passageway. However, applicant has noted that an absorptive section of this type significantly attenuates only the sound components in the higher frequency spectrum. In accordance with the present invention, the low frequency components are removed by a separate muffler stage, a preferred embodiment being shown by muffler unit 6 which is a reactive resonating cavity.

More particularly, in the illustrated embodiment of the invention, an outer wall means in the form of a cylindrical pipe 19 encircles the converging megaphone section 9 and the coupling pipe 11. The inner end of the pipe 19 abutts the beginning portion of the section 9 and is sealed thereto by a weld 20 or the like. The opposite or outer end of the pipe 19 abutts the inner end wall 17 of the muffler unit 5 and is welded as at 21 or otherwise secured and sealed thereto. The sealed pipe 19 defines a cavity 22 between the outer pipe 19, the outer surfaces of the section 9 and coupling pipe 11 and the inner end wall 17 of the muffler unit 5. The cavity 22 is coupled to the exhaust passageway at the coupling pipe 11 by a coupling throat or opening 23 in the pipe 11. Although a single opening is shown, any desired number of openings can be employed as more fully developed hereinafter.

The combination of the cavity 22 and the opening 23 defines a cavity resonator which by proper selection of volume and throat construction will resonate at a desired frequency and effectively attenuate such frequency and adjacent frequency components in the exhaust noise of the engine 1. The resonant cavity is designed to attenuate the noise components in the low frequency spectrum and thus, when combined with unit 5 to significantly reduce the total exhaust noise of the engine 1. Such a cavity resonator is described particularly in Chapter 21 of the Handbook of Noise Control by Seral Harris and published by McGraw Hill Book Co. The resonant frequency formula for a Helmholtz resonator is as follows:

$$f = (c/2\pi)\sqrt{(k/v)}$$

where $$k = n \cdot s/(t + 0.8\sqrt{s})$$

Figure 2:
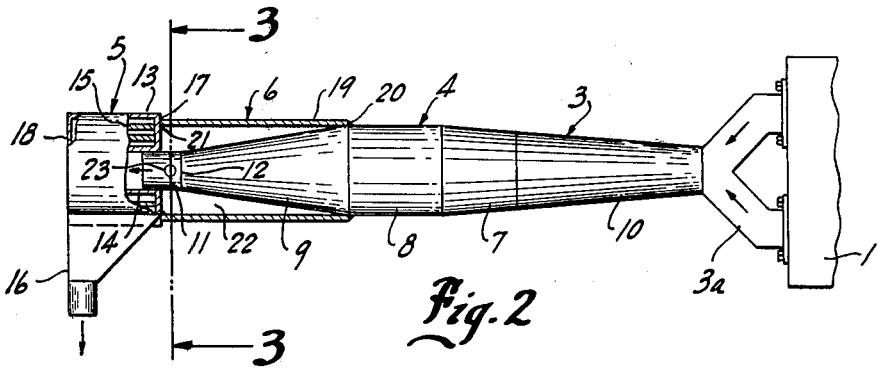
FIG. 2 is an enlarged longitudinal section taken generally on line 2—2 of FIG. 1.
Figure 3:
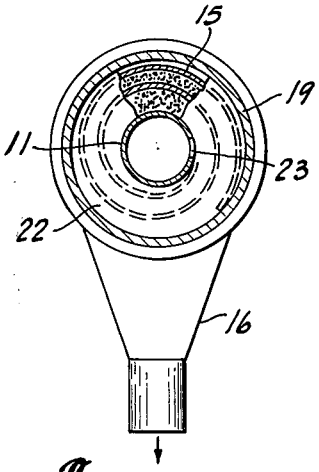
FIG. 3 is an enlarged transverse section taken generally on line 3—3 of FIG. 2.

$s$ = Area of throat
$f$ = Frequency of the resonator
$v$ = Volume of the resonator
$k$ = Conductivity of throat
$c$ = Velocity of sound
$n$ = No. of throats
$t$ = Thickness or length of throat The formula readily provides a basis for construction of the muffler cavity 22 shown in FIGS. 2 and 3. For example in a practical construction for a 2-cycle engine applied to a snowmobile, the megaphone section 9 had a length of approximately 9 inches and varies from a maximum internal diameter of 4.25 inches to a minimum of 1.12 inches at the coupling pipe 11 which had a corresponding inner diameter and a constant length of 2 inches. The outer pipe or sleeve 19 was constructed with a length of 10 inches and an internal diameter of 4.45 inches. The several pipes were formed of a similar steel tubing with the outer pipe 19 having a slightly heavier wall thickness for the purposes of strengthening the total assembly. A single coupling opening 23 having a diameter of five eight inches was provided. However, the size and configuration of the opening, as subsequently discussed, does not appear to be critical. The muffler unit as constructed developed a resonant frequency of essentially 250 hertz. This design was based on two-cycle internal combustion engine operating at approximatlely 7,000 RPM, which corresponds to a firing frequency of 233 hertz. The exhaust noise, however, includes a much larger frequency spectrum such as shown by trace 24 in FIG. 4.

Figure 4:
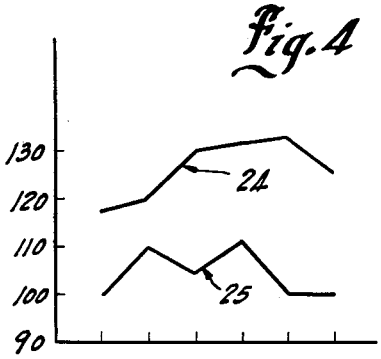
FIG. 4 is a graphical illustration showing typical noise reduction characteristics associated with the construction of FIGS. 2 and 3.

In FIG. 4, characteristics are shown comparing the noise and peak power from an exhaust system coupled to a dynomometer test unit, with a microphone placed at 3 feet from the exhaust discharge opening. Trace 24 illustrates the output with both the absorptive muffler unit 5 and the reactive muffler unit 6 removed. The noise includes sound frequencies covering the range of 250 to 8,000 hertz. Trace 25 illustrates the output with the combination of muffler units 5 and 6 connected to the coupling pipe 11. As clearly shown, the noise level is significantly reduced over the complete operating frequency spectrum. Generally, the noise reduction up to 1,000 hertz is attributable to attenuation by the reactive muffler unit 6 while above 1,000 hertz, the noise reduction is primarily due to the absorption by the absorptive muffler unit 5.

Generally, present day standards for snowmobiles and the like are set to permit a maximum decibel (DB) level of 78 at 50 feet from the vehicle. Such a level corresponds to 115 DB. Referring to FIG. 4, the sound level without the muffler is significantly above the 115 acceptable DB level over the entire spectrum. With the combined muffler system of the present invention, the noise level never rises to such an unacceptable level and is maintained significantly below even at the worst point of 2,000 hertz.

Figure 5:
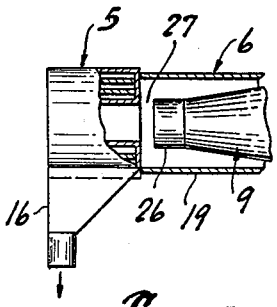
FIG. 5 is a fragmentary view similar to FIG. 2 illustrating an alternative embodiment.

Referring particularly to FIG. 5, an alternative embodiment of the invention is shown which may be conveniently mass produced. For purposes of simplicity and clarity, like components in the embodiments of FIGS. 2 – 4 are identified by the same numbers. In FIG. 5, a special coupling pipe extension 26 terminates in spaced relation to the inlet opening to the absorptive spiral muffler. The space or gap 27 constitutes a coupling opening to the low frequency reactive cavity. In a practical construction similar to that previously discussed, a space or gap of 0.28 inches ($d/4$, where $d$ is the inside diameter of the pipe 11), was found to produce a highly effective silencing of a low frequency spectrum noise. Applicant has found that the construction of FIG. 5 functions as effectively as the prior embodiment, indicating that the size and configuration of the coupling opening is not critical and may be formed in many different configurations. The illustrated embodiment is particularly adapted to commercial introduction with a minimum of cost.

The integration of the resonator cavity unit 6 into the tuned exhaust system, in accordance with one feature of this invention, is satisfactory because the design maintains a compact as well as a relatively simple and inexpensive construction. Thus, the extension of the cylindrical section of the tuned pipe to the absorptive muffler merely provides a straightforward extension of the outer configuration of the system while the required coupling provides only an insignificant increase in the total length of the exhaust system.

The present invention, thus, provides a unique dual stage silencer apparatus muffler which creates a highly balanced sound deadening over the engine operating spectrum and which can be readily incorporated into the limited space requirement encountered in recreational vehicles particularly snowmobiles.

Various modes of carrying out the invention are contemplated as being within the scope of the following claims which particularly point out the distinctly claim the subject matter which is regarded as the invention.

I claim:

1. An exhaust system for an internal combustion engine operating at an RPM in excess of about 6000 revolutions per minute, comprising an exhaust passageway means having an exhaust pipe means with a large inlet end portion and a progressively reduced passageway section to a small discharge end portion, a conduit secured to said small discharge end portion, a cylindrical cavity means secured in encircling relation to said reduced passageway section and said conduit, and a common input and output coupling passageway means between said conduit and said cavity means and providing the only flow into and out of the exhaust passageway means to the cavity means, said coupling passageway means being defined by openings in the conduit, said openings having a length of the thickness of the conduit and selected of a selected area and being located at essentially the smallest cross-section of the passageway means whereby said cavity means defines a dead-ended resonant cavity operable to attenuate noise frequencies of the exhaust gas pressure waves.

2. The apparatus of the claim 1 wherein said coupling passageway means and said cavity means defines a Helmholtz resonator.

3. The apparatus of claim 2 wherein said exhaust passageway means includes an absorptive muffler.

4. The apparatus of claim 3 wherein said absorptive muffler has an end wall adjacent the end of the conduit and said resonant cavity means is immediately adjacent said absorptive muffler and is defined by an outer tubular shell of a diameter corresponding to said large end and having one end welded directly to the end wall of the absorptive muffler and the opposite end welded directly to the enlarged inlet end portion of the reduced section of the exhaust pipe means to define said resonant cavity.

5. The apparatus of claim 4 wherein said absorptive muffler is a high frequency attenuator and said cavity means and coupling passageway means are of a preselected area and volume which in combination defines a low frequency attenuator for attenuating low frequencies in a range of the noise frequency spectrum adjacent the frequencies of the high frequency attenuator.

6. In combination, an internal combustion engine having an operating speed in excess of the order of 6,000 RPM, a tuned exhaust system connected to said engine and including a converging discharge pipe section having a large inlet end and terminating in a narrow end discharge opening, a tubular extension pipe connected to said converging pipe section and having an essentially constant cross-section corresponding to the discharge opening, said extension pipe being aligned with and extending outwardly from the discharge opening, an absorptive muffler secured to the outer end of the extension pipe, a dead-ended side branch cavity means having an outer wall secured to said converging discharge section and to said absorptive muffler to form a closed chamber, said extension pipe having a wall opening forming common input-output coupling passageway means for introducing exhaust pressure waves into said cavity means and for releasing the pressure from within said cavity means through the same passageway means, said passageway means having a length equal to the thickness of the wall of the pipe section and said cavity means being selected to resonate at a pre-selected frequency within the exhaust noise spectrum and thereby attenuating a band of noise frequencies.

7. In the combination of claim 6 wherein the said preselected frequency is selected to attenuate a range of low frequencies in the noise frequency spectrum, and an absorptive muffler is connected to the tubular extension pipe and constructed to attenuate a range of high frequencies in the exhaust noise spectrum.

8. In the combination of claim 6 wherein said absorptive muffler has an end wall adjacent the extension pipe at least as large as said large inlet end, said outer wall is cylindrical with a diameter substantially equal to the large inlet end and is directly secured in encircling relation to the large inlet end of said coverging discharge section and to the wall of the muffler to define an annular resonant cavity.

9. In the combination of the claim 8 wherein said cavity means defines a Helmhotz's resonator.

10. In the combination of claim 8, wherein said absorptive muffler is a cylindrical spiral muffler secured to the end of the closed chamber with an inlet aligned with and spaced axially from the extension pipe to define the coupling passageway and said spiral muffler being operative to attenuate a second band of noise frequencies in a different frequency range in the frequency spectrum of the exhaust noises from the first named band of noise frequencies.

11. In the combination of claim 10 wherein said first and second frequency ranges are immediately adjacent frequency ranges.

12. Silencing apparatus for an internal combustion engine and the like comprising a tuned exhaust pipe having an inlet expanding megaphone section, a straight pipe section and a converging megaphone section terminating in an open discharge end, a tubular coupling pipe duct secured to the discharge end of said converging megaphone section, a high frequency muffler including a housing defining a chamber, said housing having an outer cylindrical wall of a diameter generally corresponding to the diameter of the straight pipe section of the tuned exhaust pipe and having an inner planar end wall with an opening aligned with the pipe duct, an outer wall encircling the converging megaphone section and having one end abutting the planar end wall of the high frequency muffler and having the opposite end abutting the converging megaphone section and sealed thereto, and said coupling pipe duct being spaced from the planar end wall to define a cavity coupling opening, the diameter of said outer wall and the size of said opening selected in accordance with a Helmholtz resonator construction to resonate at a predetermined frequency in the lower range of the exhaust frequency spectrum.

13. The apparatus of claim 12 wherein said high frequency muffler including a spiral passageway from the center of the chamber to the outer cylindrical wall and including a noise absorbent material for absorbing high frequency noise pressure waves within the exhaust noise frequency spectrum in the exhaust gases.

* * * * *